United States Patent [19]

Meyer

[11] Patent Number: 5,003,668

[45] Date of Patent: Apr. 2, 1991

[54] TEXTILE SPINNING MACHINE

[75] Inventor: Urs Meyer, Niederglatt, Switzerland

[73] Assignee: Rieter Machine Works, Ltd., Winterthur, Switzerland

[21] Appl. No.: 462,656

[22] Filed: Jan. 9, 1990

[30] Foreign Application Priority Data

Jan. 9, 1989 [DE] Fed. Rep. of Germany ..... 3900409

[51] Int. Cl.[5] ..... D01G 31/00

[52] U.S. Cl. ..... 19/0.22; 19/0.2; 19/0.25; 19/236

[58] Field of Search ..... 19/0.2, 0.21, 0.22, 19/0.25, 236, 242; 57/97, 315, 316, 317, 327, 331

[56] References Cited

U.S. PATENT DOCUMENTS 4,100,649 7/1978 Erismann et al. ..... 19/0.2
4,569,192 2/1986 Yamada et al. ..... 57/317

FOREIGN PATENT DOCUMENTS 2753924 6/1976 Fed. Rep. of Germany ..... 57/317
3417779 12/1984 Fed. Rep. of Germany ..... 19/236
878524 10/1961 United Kingdom ..... 19/0.25
2019460 10/1979 United Kingdom ..... 19/236
2044302 10/1980 United Kingdom ..... 57/317

*Primary Examiner*—Werner H. Schroeder
*Assistant Examiner*—Michael A. Neas
*Attorney, Agent, or Firm*—Kenyon & Kenyon

[57] ABSTRACT

The textile machine, for example a spinning machine, comprising at least one drawing system consisting of a plurality of runs, such as pairs of rollers and the like. At least two such runs each have a cylinder having markings which are detected by a sensor of a separate pulse generator. The output signal $S_1$ of one pulse generator is applied to a count input of a counter while the output signal $S_2$ of the other pulse generator is applied to a reset input of the counter. The counter can be reset by the output signal $S_2$ only during a preset reset time window. When the counter has counted to the end of this time window, the counter furnishes a trigger signal $S_3$ for an alarm and the like.

15 Claims, 2 Drawing Sheets

Figure 3:
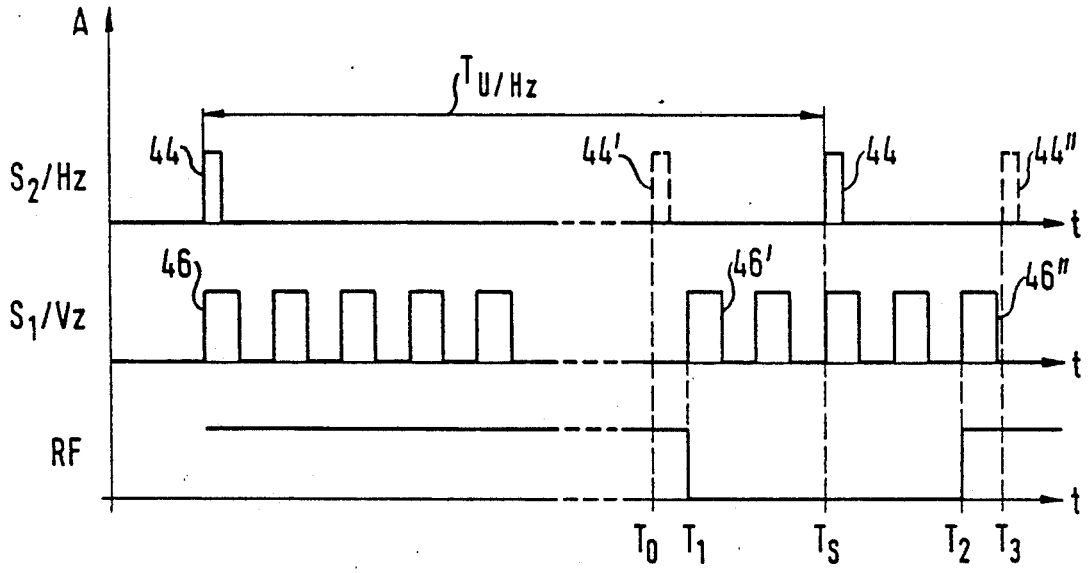

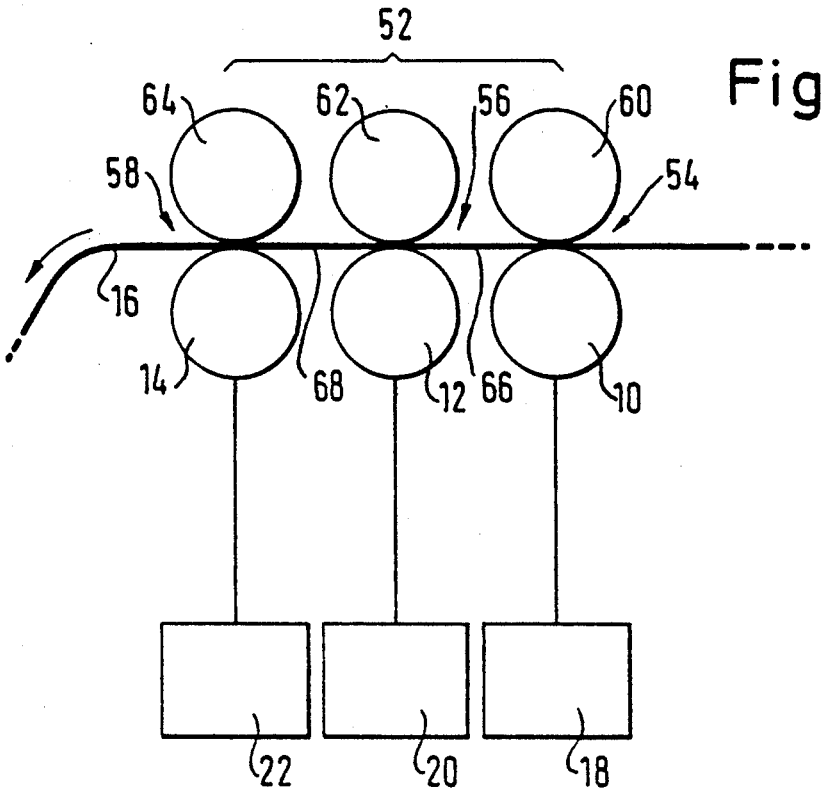
Fig. 1
Fig. 2
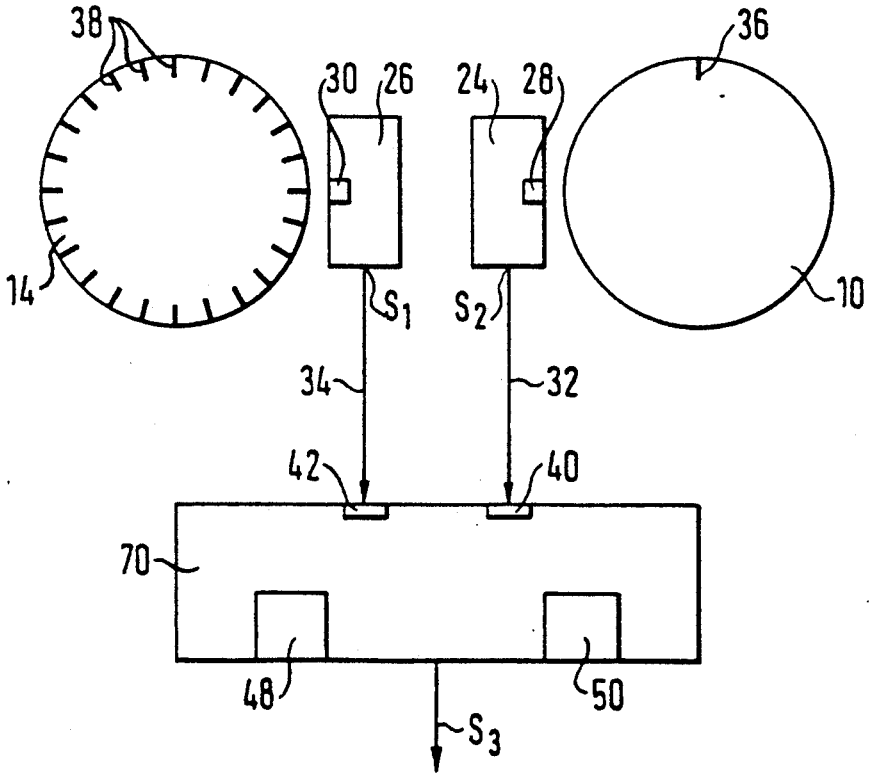

TEXTILE SPINNING MACHINE

The invention relates to a textile machine, in particular a spinning machine comprising at least one drawing system consisting of a plurality of runs such as, in particular, pairs of rollers, cylinders/rollers and the like to form at least one drawing section between two such runs which can be driven at differing, in particular adjustable rotary speeds to produce drawing.

In ring spinning machines, for instance, attempts have been made recently to decentralize the formerly common central drive system for the various drive elements; this applying, in particular, to the drive of the drawing system. A single drawing drive eliminates, in particular, change gearwheels, permits facilitated and speedy control and makes it possible to employ remote control and fine settings.

Essential to satisfactory operation is not only smooth running of the drawing runs comprising pairs of rollers or cylinders/rollers and the like, but also the rotary speed ratios of the runs decisively influence, in particular, maintaining the yarn count. The runs are required, in particular, to start "precise to a gear", i.e. in a prescribed ratio of rotary angles from standstill and stopped just as precisely when adjustment is made. Also during normal operation of the spinning machine involved it is mandatory to keep to the stated speed ratios to maintain a consistently high yarn quality.

Due to driving at least part of the drawing runs separately, certain deviations of the speed cannot be eliminated absolutely. As a result of automation to a major degree there is now the risk, particularly when minor drawing errors occur, that these are not detected at all, or only in lab testing or too late so that the quality of the yarn in major portions of the produced material is impaired.

The objective of the invention resides in creating a textile machine of the aforementioned type providing extremely facilitated means of reliably monitoring the drawing system particularly as regards maintaining the prescribed speed ratios of the various drawing runs.

Briefly, in accordance with the invention at least two runs of the drawing system are assigned a pulse generator responding to markings of a roller or cylinder of the run involved with the output signals of each pulse generator having pulse repetition frequencies which differ in operation and depend on the corresponding cylinder speed and the number of markings in each case. In addition, the output signal having a higher pulse repetition frequency is applied to a counter input and the output signal having a lower pulse repetition frequency is applied to a reset input of an electronic counter. Further the counter can be reset by the second output signal only during a count interval as dictated by a lower count limit (MIN) and an upper count limit (MAX). the electronic counter furnishes a trigger signal to trigger an alarm, a machine shutdown signal and the like on timeout of the count interval constituting a reset window.

This embodiment enables even minute deviations in the rotary speed of drawing runs and thus yarn errors, which would otherwise be difficult to detect, to be reliably and speedily sensed using the simplest means. The precision with which the remaining drawing errors are to be sensed can be dictated by the number of markings, in particular by the differences in the number of these markings on the cylinders of run pair in each case, by the width of the generated pulse and by the width of the time interval or reset window.

The counter is incremented, for instance, by the pulses of the first output signal having a higher pulse repetition frequency. When the counter MIN value is attained a kind of reset window is opened which is reclosed when the MAX value is attained. Should a pulse of the second output signal having a lower pulse repetition frequency occur in the opened reset window, the counter is reset as soon as this pulse occurs and then reincremented by the pulses of the first output signal. The pulse repetition frequency of the second output signal is particularly selected by the relative number of markings that at no time can two pulses of this signal occur in the reset window. Should a corresponding pulse of the second output signal occur too early, as regards the reset window, the counter can then not be reset. This has the result that when the MAX value is attained, for example, a signal is output for an alarm, machine shutdown and the like, the same applies should the corresponding pulse of the second output signal occur too late as regards the reset window. Here too, namely, the MAX value is attained, for example, and the corresponding trigger signal output.

In a similar way a decrementing counter can also be used; in this case, the criterion determining output of the trigger signal is violation of the MIN value of the counter.

Although the invention is preferably intended to monitor the relative rotary speeds of drawing runs, it is just as useful in also monitoring the relative speeds, particularly, of the input run of the drawing system and of the spindles. The drawing system (and the ring bench) must be moved with respect to the spindles namely so that no thread breakage occurs and that yarn quality is the same in starting and stopping as in normal operation.

A special advantage of the means for monitoring the drawing system by this invention is that they can be achieved by such simple and low cost components as, in particular, electronic counters and the like.

Preferably the cylinder of the faster run of the drawing system has a higher number of markings than that of the slower run, thus achieving by simple means a pulse repetition frequency of the first output signal for counting which is higher by several magnitudes, so that narrow pulses of the second output signal extending beyond this enable, all in all, a higher resolution to be achieved. Resolution is highest when the reset window or count interval is smallest, as determined by the spacing of two pulses of the first pulse generator output signal producing the count. The cylinder having the lower number of markings may usefully have but a single marking. In this way the relative difference in the number of markings and thus of the pulse repetition frequencies of the two pulse generator output signals is increased by far which further improves the resolution in sensing the drawing error.

In this arrangement the higher number of markings of the cylinder involved may be usefully at least ten times, preferably ten times to a thousand times and, in particular, one hundred times the lower number of markings of the other cylinder involved.

The markings are preferably arranged on the periphery of the cylinders and are distributed uniformly over the periphery of the cylinder when a plurality of markings is provided per cylinder. When the cylinders rotate, this results in a constant pulse repetition frequency for the cylinder concerned as long as it is driven at a constant speed.

In accordance with one preferred embodiment of the invention, a pulse generator is assigned separately to the rear or input run and to the front or output run; this being particularly useful when the middle run and the rear run of the drawing system are connected together via a gearing and can be driven by a common drive whilst the front or output run is driven separately.

Should, by comparison, in even further decentralization of the drive, all drawing runs be provided for separate drive, it is of advantage to assign a pulse generator to each run and to apply the output signals of both pulse generators assigned to each pair of runs to the count input or reset input of an electronic counter in each case. In this arrangement, the relative speed of the rear run and the middle run and/or rear run and front run and/or middle run and front run can be monitored.

Should a common rear cylinder, a common front or output cylinder and, if necessary, a common middle cylinder be provided in each case for a plurality of drawing runs, the markings are best arranged on the corresponding common, preferably lower cylinders or rollers.

The electronic counter can be part of a digital tachometer to enable, for example, absolute speeds to be indicated at the same time also.

The prescribable MIN and MAX counter limits determining the reset time window can be stored, by preference programmable, in the electronic counter or digital tachometer. In order to store these MIN and MAX counter limits, it is useful to provide a memory having a battery backup so that the entered values remain available even when the system is restarted.

In a further practical embodiment of the textile machine according to the invention, the electronic counter or digital tachometer has a digital display particularly for displaying the measured rotary speeds and/or differences thereof.

The pulse generators responding to the markings can incorporate optical, inductive and/or capacitive sensors.

The invention will now be described by way of an example embodiment hereinafter with the aid of the drawings, wherein:

FIG. 1 is a schematic plan view of a drawing system of a ring spinning machine incorporating three runs, FIG. 2 is a schematic plan view of the rear and output cylinders showing the markings as used in the drawing system as shown in FIG. 1 featuring means for monitoring the speed ratio as assigned, and FIG. 3 is a timing diagram showing the pulse generator output signal which—as the first signal—is applied to the counter input and—as the second signal—is applied to the reset input as derived from the front cylinder and rear cylinder respectively, together with the reset time window of the electronic counter used.

In accordance with FIG. 1 a drawing system 52 is shown schematically as part of a ring spinning machine for example.

The drawing system is shown to comprise a rear or intake run 54, a middle run 56 and a front or output run 58. The card sliver or thread 16 is furnished by output run 58 to e.g. a spindle of the corresponding ring spinning machine.

The runs 54, 56, 58 of the drawing system 52 each comprise a bottom cylinder, namely the rear or intake cylinder 10, middle cylinder 12 and the front or output cylinder 14 and, on the other hand, an upper roller each, namely the rear or intake roller 60, the middle roller 62 and the front or output roller 64.

The bottom cylinders 10, 12, 14 are each intended at the same time for a plurality of drawing systems on a corresponding end of the machine. Each of these cylinders is assigned a particular drive 18, 20, 22. These drives can each comprise a drive motor which is speed controlled via the supply frequency. The speed of the drawing system runs increases from the intake run 54 to the front output run 58 so that between the first run pair 54,56 a predrawing section 66 and between the second run pair 56,58 a main drawing section 68 is formed.

In accordance with FIG. 2, the rear cylinder 10 and output cylinder 14 have markings 36,38. These markings are each arranged around the periphery of the corresponding cylinder 10,14 and are sensed by sensors 28,30 of two pulse generators 24,26. The one pulse generator 24 or its sensor 28 is arranged in the periphery area of the rear cylinder 10 driven at a low speed, whilst the other pulse generator 26 is located in the periphery area of the front or output cylinder 14 rotating at a higher speed.

Pulse generator 26 furnishes via a signal line 34 a first output signal $S_1$ to a count input 42 of an electronic counter 70 formed, for example, by a digital tachometer. The pulse generator 24 assigned to the rear cylinder 10 furnishes a second output signal $S_2$ via a signal line 32 to a reset input 40 of the electronic counter 70.

Sensors 28,30 can be optical, inductive or capacitive sensors, for example. The two pulse generators 24,26 comprise pulse shaping circuits for outputting at least substantially rectangular pulses.

Whilst rear cylinder 10 rotating in operation at a high speed has merely a single marking 36 on its periphery, the faster rotating front or output cylinder 14 features a larger number of such markings 38 on its periphery. In the present embodiment example one hundred such markings 38 are provided for the rear cylinder 14. Whilst pulse generator 24 outputs merely one pulse per full rotation of rear cylinder 10, pulse generator 26 furnishes one hundred such pulses for each full rotation of output cylinder 14. The rear cylinder 10 can, for example, be driven in a speed range of 0.9 thru 45 rpm and the output cylinder 14, for instance, in a speed range from 15 thru 480 rpm, thus resulting in values of 0.75 Hz and 850 Hz respectively for the maximum frequency.

The electronic counter 70 or digital tachometer has two set inputs 48, 50 for setting a lower (MIN) and an upper (MAX) counter limit. These two separate MIN and MAX counter values establish a count interval determining a reset time window $T_1$ thru $T_2$ of the electronic counter 70 ( cf. also FIG. 3). The electronic counter 70 can be reset by each of the pulses of pulse generator 24, i.e. of the second pulse generator output signal $S_2$ only during this preset time interval or reset time window. Should a pulse (derived from the marking 36) of this second pulse generator output signal $S_2$ occur too early or too late as regards the set reset window $T_1$ thru $T_2$, the electronic counter 70 is then not reset which causes in the case of an incrementing (ascending) counter the MAX limit to be achieved, and in the case of a decrementing (descending) counter the MIN limit to be achieved. After timeout of the reset time window and achieving the corresponding limit, the electronic counter 70 furnishes a trigger signal $S_3$ as an alarm, for example, a machine standstill signal and the like.

In the present embodiment, example an ascending counter is provided as the electronic counter 70, as can be seen in particular also from the timing diagram according to FIG. 3.

In FIG. 3, in the top part of the timing diagram pulses 44 derived from rear cylinder 10 are shown. Since the rear cylinder 10 has merely a single marking 36 (cf. FIG. 2), the time $T_{U/Hz}$ is the time, for example, between the leading edges of two resulting pulses 44 required for one full rotation of the rear cylinder 10. During this rotation time $T_{U/Hz}$ relative to the rear cylinder 10, one hundred pulses 46 derived from the markings 36 of the front cylinder 14 of the first pulse generator output signal $S_1$ occur when the setpoint speed ratio is maintained. In the diagram as shown in FIG. 3, only part of the pulses 46 is shown.

Pulses 44,46 of the two output signals $S_2$ or $S_1$ have the same amplitude A. Although in the example shown, the pulse width of pulses 44 is less than that of pulses 46, this pulse width generally is irrelevant; much more important are the edges of the pulses.

As can also be seen from the timing diagram in FIG. 3, the reset time window RF is opened at time $T_1$ and reclosed at time $T_2$. In this example, the RF signal is logic zero when the reset time window or reset port is open and logic one when RF is closed.

Time $T_1$ is determined by the leading edge of pulse 46' of the first pulse generator output signal $S_1$ —in the present embodiment example—which, as soon as it occurs, causes the ascending electronic counter 70 to assume the MIN counter limit as set by the first set input 48.

The MIN counter limit can be set to 3752 for example. Time $T_2$ forming the upper limit of the reset time window is determined by the leading edge of a pulse 46'' of the first pulse generator output signal $S_1$ which, when it occurs, causes the electronic counter 70 to assume the MAX counter limit which can be adjusted by means of the second set input 50. In this example this MAX counter limit is set to 3756.

When pulse 44 occurs within the reset time window $T_1$ thru $T_2$ the electronic counter 70 is reset before again incrementing e.g. to the next reset time.

When a pulse 44' or its leading edge occurs at a time $T_0$ before the reset time window $T_1$ thru $T_2$, the pulse 44' is not able to reset the counter. Since the time spacing of the resulting pulses 44 is, in particular, much larger than the aforementioned time window $T_1$ thru $T_2$ no further pulse 44 occurs during this reset time window in the last-mentioned case so that counter 70 increments to the MAX counter limit, which in this example is 3756, to output the trigger signal $S_3$ for e.g. an alarm, a machine shutdown and the like. This MAX counter limit is achieved at time $T_2$ as shown in FIG. 3.

The MAX counter limit is attained also by the same sequence when a pulse 44'' of the second pulse generator output signal $S_2$ occurs at time $T_3$ later than time window $T_1$ thru $T_2$. In this case too, namely none of pulses 44 occurs in time window $T_1$ thru $T_2$ and thus counter 70 cannot be reset although the MAX counter limit is attained.

By entering the MAX and MIN counter limits via the set inputs 48, 50 the width of the reset time window $T_1$ thru $T_2$ can be varied. Minimum width is preset by the spacing of the edges of two successive pulses 46 of the first output signal $S_1$ furnished by pulse generator 26.

The narrower the reset time window $T_1$ thru $T_2$ the greater the sensitivity of the monitoring as regards drawing errors.

Whilst in the embodiment example described, only the rear cylinder 10 and the output cylinder 14 have markings 36, 38 it is also quite feasible to provide all cylinders 10, 12, 14 i.e. in particular also the middle cylinder 12 with such markings and to assign a pulse generator and sensor accordingly.

Whilst in accordance with FIG. 1 separate drives 18, 20 are assigned to the rear cylinder 10 and the middle cylinder 12, it is also feasible that a common drive is provided for these two cylinders and to couple these cylinders together via mechanical gearing. In this case it would be sufficient to assign a pulse generator to either the rear cylinder 10 or to the middle cylinder 11 and to provide this cylinder with suitable markings.

Particularly for the case in which all drawing runs 54, 56, 58—as shown in FIG. 1—can be driven separately, a separate pulse generator can be assigned to each run and the output signals of the two pulse generators assigned to each run pair, 54,56; 56,58 applied to the count input 42 or reset input 40 of each electronic counter.

A particularly favorable arrangement is to form the electronic counter 70 by part of a digital tachometer by means of which absolute speeds and/or speed ratios can be indicated.

To make sure that whenever the spinning machine is restarted defined operating conditions exist as regards the run monitoring provided, the preset MIN and MAX counter limits can be stored programmable in the electronic counter 70 or the digital tachometer. In this case it is good practice to provide a memory having a battery backup for storing the counter limits so that these values are not lost even when a power outage occurs.

Although markings 36, 38 are best arranged on the lower cylinders 10, 14 and, if necessary, on cylinder 12 it is also quite feasible to provide these markings on the upper rollers 60, 62, 64.

Whilst the embodiment example describes monitoring limited to the runs, the monitoring device described can also be employed to monitor the relative speed ratios particularly of the output run 58 and of the corresponding spindles.

Instead of the single marking on the slower rotating cylinder it is also quite feasible to provide a higher number of markings, particularly the same number of markings, as in the faster running run, it then being good practice to insert a divider module downstream of the assigned pulse generator to restore receiving one pulse per revolution.

In addition, it is also feasible to assign such a predivider to the other run or to both runs; providing such a divider module eliminating the requirement that one of the two runs must run slower.

When using the divider modules as stated, it is also possible , among other things, to implement identical pulse generators or digital tachometers on both shafts. With the exception of the pulse generators these elements can also be achieved, for example, as software modules of a microprocessor program.

I claim:

1. A textile machine comprising at least one drawing system having a plurality of runs forming at least one drawing section, one run of said system having a cylinder with a plurality of circumferentially disposed markings and a second run of said system having a cylinder with at least one marking thereon and being rotatable at a rotary speed different from said cylinder of said one run;

a first pulse generator for responding to said markings of said cylinder of said one run to generate a first output signal having a pulse repetition frequency corresponding to the speed and number of markings of said cylinder of said one run;

a second pulse generator for responding to said one marking on said cylinder of said second run to generate a second output signal having a pulse repetition frequency corresponding to the speed of said one marking; and an electronic counter having a count input for receiving said first signal and a reset input for receiving said second signal, said counter being reset in response to reception of said second signal during a time interval corresponding to a time between reception of a minimum number of pulses from said first signal and a maximum number of pulses from said first signal, said counter generating a trigger signal for an alarm in response to said second signal not being received in said time interval.

2. A machine as set forth in claim 1 wherein said counter has a first set input for entering a pulse count value corresponding to said minimum number of pulses and a second set input for entering a pulse count value corresponding to said maximum number of pulses.

3. A machine as set forth in claim 1 wherein said cylinder of said one run rotates at a faster rotary speed than said cylinder of said second run.

4. A machine as set forth in claim 1 wherein said markings of said cylinder of said one run are at least ten times the number of markings on said cylinder of said second run.

5. A machine as set forth in claim 1 wherein said system has three runs defining two drawing sections, said one run being the front run of said system and said second run being the rear run of said system.

6. A machine as set forth in claim 1 wherein said cylinder of each of said one run and said second run extends over a plurality of drawing sections in common relation thereto.

7. Textile machine according to claim 1, characterized in that a divider module is included in the output of at least one of the two pulse generators and that the assigned cylinder includes the same number of markings as the cylinder assigned to the other pulse generator.

8. Textile machine according to claim 1 characterized in that said markings are arranged on and are distributed uniformly over the periphery of said cylinder of said one run.

9. Textile machine according to claim 1 characterized in that all drawing runs can be driven separately, that each run is assigned a pulse generator and that said output signals of said two pulse generators assigned to each run pair are applied to said count input or reset input of each electronic counter.

10. Textile machine according to claim 1 characterized in that said electronic counter is a digital counter.

11. Textile machine according to claim 1 characterized in that said electronic counter is a digital counter.

12. Textile machine according to claim 1 characterized in that the minimum and maximum counter limits can be stored programmable in said electronic counter.

13. Textile machine according to claim 12, characterized in that a battery-backup is provided to store said minimum and maximum counter values.

14. Textile machine according to claim 1 characterized in that said electronic counter comprises a digital display for readout of the measured rotary speeds and differences thereof.

15. Textile machine according to claim 1 characterized in that said pulse generators responding to said markings comprise one of optical, magnetic, inductive and capacitive sensors.

* * * * *

UNITED STATES PATENT AND TRADEMARK OFFICE

CERTIFICATE OF CORRECTION

PATENT NO. : 5,003,668

DATED : April 2, 1991

INVENTOR(S) : URS MEYER

It is certified that error appears in the above-identified patent and that said Letters Patent is hereby corrected as shown below:

Column 1, line 56 change "the" to -The-
Column 5, line 1 change "embodiment, example an" to -embodiment example, an- Column 8, line 28 change "battery-backup" to -battery-backup memory-

Signed and Sealed this

Tenth Day of November, 1992

*Attest:*

DOUGLAS B. COMER

*Attesting Officer*

*Acting Commissioner of Patents and Trademarks*